US008443463B2

(12) United States Patent
Paull

(10) Patent No.: US 8,443,463 B2
(45) **Date of Patent: *May 21, 2013**

(54) EVAPORATIVE COOLING CLOTHING SYSTEM FOR REDUCING BODY TEMPERATURE OF A WEARER OF THE CLOTHING SYSTEM

(76) Inventor: Leslie Owen Paull, Bastrop, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/196,899

(22) Filed: Aug. 3, 2011

(65) Prior Publication Data

US 2011/0283722 A1 Nov. 24, 2011

Related U.S. Application Data

(63) Continuation of application No. 12/186,674, filed on Aug. 6, 2008, now Pat. No. 8,015,618.

(51) Int. Cl.
*A41D 13/00* (2006.01)

(52) U.S. Cl.
USPC ..... 2/69

(58) Field of Classification Search
USPC .... 2/69, 81, 69.5, 102, 2.14, 456, 2.5; 62/3.5, 62/259.3
See application file for complete search history.

(56) References Cited

U.S. PATENT DOCUMENTS

| | | | |
|---|---|---|---|
| 594,209 | A | 11/1897 | Mears |
| 2,403,676 | A | 7/1946 | Modlinski |
| 2,566,533 | A | 9/1951 | Poux |
| 3,125,865 | A | 3/1964 | Bemelman |
| 3,452,554 | A | 7/1969 | Smith |
| 3,610,323 | A | 10/1971 | Troyer |
| 3,717,145 | A | 2/1973 | Berndt et al. |
| 3,950,789 | A | 4/1976 | Konz et al. |
| 4,005,494 | A | 2/1977 | Burn |
| 4,130,902 | A | 12/1978 | Mackenroth, III et al. |
| 4,601,067 | A | 7/1986 | Buonassissi |
| 4,641,655 | A | 2/1987 | Abt |
| 4,688,572 | A | 8/1987 | Hubbard |
| 4,738,119 | A | 4/1988 | Zafred |
| 4,776,042 | A | 10/1988 | Hanson et al. |
| 4,805,619 | A | 2/1989 | Swearingen |
| 4,805,620 | A | 2/1989 | Meistrell |
| 4,931,333 | A | 6/1990 | Henry |

(Continued)

FOREIGN PATENT DOCUMENTS

| | | |
|---|---|---|
| EP | 0217107 | 4/1987 |
| WO | WO2008/009979 A2 | 1/2008 |

OTHER PUBLICATIONS

International Search Report mailed Sep. 14, 2009 for PCT/US2009/051552 filed Jul. 23, 2009.

*Primary Examiner* — Tejash Patel
(74) *Attorney, Agent, or Firm* — Thomas D. Fortenberry

(57) ABSTRACT

The present invention discloses an evaporative cooling clothing system for reducing body temperature of a wearer of the clothing system. The clothing system includes a clothing article configured using a wicking fabric and a hollow transport defining a cavity for transporting a liquid from a liquid reservoir to an upper region of the clothing article. The hollow transport has an intake section and a dispensing section. The intake section is attached to the liquid reservoir for receiving the liquid, and the dispensing section is attached to the upper region of the clothing article. The upper region of the clothing article receives the liquid from the dispensing section and transfers the liquid to a lower region of the clothing article. The lower region of the clothing article exposes the liquid to an environment surrounding the clothing article for evaporation.

20 Claims, 6 Drawing Sheets

U.S. PATENT DOCUMENTS

| | | | |
|---|---|---|---|
| 4,964,282 | A | 10/1990 | Wagner |
| 5,005,374 | A | 4/1991 | Spitler |
| 5,016,629 | A | 5/1991 | Kanare |
| 5,031,244 | A | 7/1991 | Inagaki |
| 5,038,779 | A | 8/1991 | Barry et al. |
| 5,069,208 | A | 12/1991 | Noppel |
| 5,072,455 | A | 12/1991 | St. Ours |
| 5,133,348 | A | 7/1992 | Mayn |
| 5,150,707 | A | 9/1992 | Anderson |
| 5,305,471 | A | 4/1994 | Steele et al. |
| D348,733 | S | 7/1994 | Truelove |
| 5,411,493 | A | 5/1995 | Rodriguez |
| 5,415,222 | A | 5/1995 | Colvin et al. |
| 5,424,519 | A | 6/1995 | Salee |
| 5,438,707 | A | 8/1995 | Horn |
| 5,524,293 | A | 6/1996 | Kung |
| 5,606,746 | A | 3/1997 | Shelton et al. |
| 5,692,380 | A | 12/1997 | Cox et al. |
| 5,715,533 | A | 2/1998 | Stein |
| 5,787,505 | A | 8/1998 | Piwko et al. |
| 5,940,880 | A | 8/1999 | Phillips |
| 5,956,759 | A | 9/1999 | Benedict |
| 5,970,519 | A | 10/1999 | Weber |
| 6,050,099 | A | 4/2000 | Lopa et al. |
| 6,125,645 | A | 10/2000 | Horn |
| 6,189,237 | B1 | 2/2001 | Mayer et al. |
| 6,189,327 | B1 | 2/2001 | Strauss et al. |
| 6,560,779 | B1 | 5/2003 | Savage et al. |
| 7,120,928 | B2 | 10/2006 | Sheth et al. |
| 7,681,249 | B2 | 3/2010 | Oliver et al. |
| 7,698,905 | B1 | 4/2010 | Carpenter et al. |
| 2004/0128747 | A1 | 7/2004 | Bumbarger et al. |

EVAPORATIVE COOLING CLOTHING SYSTEM FOR REDUCING BODY TEMPERATURE OF A WEARER OF THE CLOTHING SYSTEM

This application claims the benefit of and is a continuation of Non-Provisional application Ser. No. 12/186,674 entitled "EVAPORATIVE COOLING CLOTHING SYSTEM FOR REDUCING BODY TEMPERATURE OF A WEARER OF THE CLOTHING SYSTEM" and filed on Aug. 6, 2008, which is incorporated herein by reference in its entirety.

TECHNICAL FIELD

The present invention relates to the field of clothing designed to reduce the body temperature of a wearer of the clothing, and in particular to reduce the wearer's body temperature through evaporative cooling.

BACKGROUND ART

Clothing is traditionally used to protect a wearer's body from the surrounding environment, particularly adverse weather, strong sunlight, extreme heat or cold, precipitation, or wind. Clothing is also worn for safety, comfort, modesty, and to reflect religious, cultural, and social values of an individual. Often, clothing is adapted for specialized purposes in which a person wearing the clothing is engaged. Examples of clothing adapted for specialized purposes include a swimsuit, motorcycle leathers, high-visibility clothing, protective clothing, and so on.

One particularly important type of clothing is clothing designed to aid the body's own cooling mechanism. Under certain conditions, a person's body temperature is elevated to a level that is higher than normal. This rise in body temperature may occur because the person is playing sports, exercising, exposed to the sun, or variety of other reasons. To counteract the rise in a person's body temperature, the body begins to perspire, producing sweat to transport excess thermal energy from inside the body to the surface of the skin for evaporation. The sweat's evaporation in turn cools the body. Clothing designed to aid the body's natural cooling process wicks sweat away from the skin for distribution throughout the clothing, and eventually evaporation from the clothing's outer surface. Wicking the sweat away from the skin has the effect of cooling the body because the wicking process removes the thermal energy in the sweat from the body. Clothing designed to aid the body's cooling process in this manner comes in variety of forms and is often designated as active wear, sportswear, stay dry clothing, and the like.

The drawback to the clothing described above is that it relies completely on the sweat produced by a person's own body to facilitate any temperature reduction. Often, however, the body's ability to expel thermal energy through the perspiration process alone is insufficient to reduce the body's temperature to a level that allows a person to achieve maximum endurance during an particular temperature elevating activity. Accordingly, a person must stop or temporarily suspend the activity sooner rather than later to provide the body with sufficient time to cool. For a cyclist, for example, this drawback translates into fewer miles of bike riding. For a road construction worker exposed to the sun, this drawback may translate into less productivity and increased risk of sun stroke.

SUMMARY OF INVENTION

The present invention discloses an evaporative cooling clothing system for reducing body temperature of a wearer of the clothing system. The clothing system includes a clothing article configured using a wicking fabric and a hollow transport defining a cavity for transporting a liquid from a liquid reservoir to an upper region of the clothing article. The hollow transport has an intake section and a dispensing section. The intake section is attached to the liquid reservoir for receiving the liquid, and the dispensing section is attached to the upper region of the clothing article. The upper region of the clothing article receives the liquid from the dispensing section and transfers the liquid to a lower region of the clothing article. The lower region of the clothing article exposes the liquid to an environment surrounding the clothing article for evaporation.

In some embodiments, the clothing article may be implemented as a garment for covering an upper torso of the wearer. The upper region of such a garment may have a neck region and a shoulder region. Accordingly, the dispensing section may be configured along the neck region and the shoulder region to attach to the clothing article's upper region. In still other embodiments, the upper region of the clothing article may include a spinal region extending along the center rear portion of the garment. In these other embodiments, the dispensing section may be configured along the neck region, the shoulder region, and the spinal region.

In some embodiments, the dispensing section may include a plurality of orifices through which the dispensing section transfers the liquid from the cavity to the upper region of the clothing article. The dispensing section may be removably attached to the upper region of the clothing article. The dispensing section may be attached to the upper region of the clothing article by insertion into a sheath attached to the upper region of the clothing article. In some embodiments, the dispensing section may be wrapped in a fabric to distribute the liquid around the outer surface of the dispensing section to facilitate the transfer of the liquid to the upper region of the clothing article.

To regulate the rate at which the liquid is received by the hollow transport, a clothing system according to some embodiments of the present invention may also include a valve attached to the intake section. The liquid may be stored under pressure in the liquid reservoir to facilitate the flow of the liquid through the hollow transport, which may be tubular, trapezoidal, square, elliptical, or a variety of other shapes. In additional embodiments, the wicking fabric may include an ultraviolet light absorber to protect the wearer's body from the sun's harmful radiation.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

Figure 1:
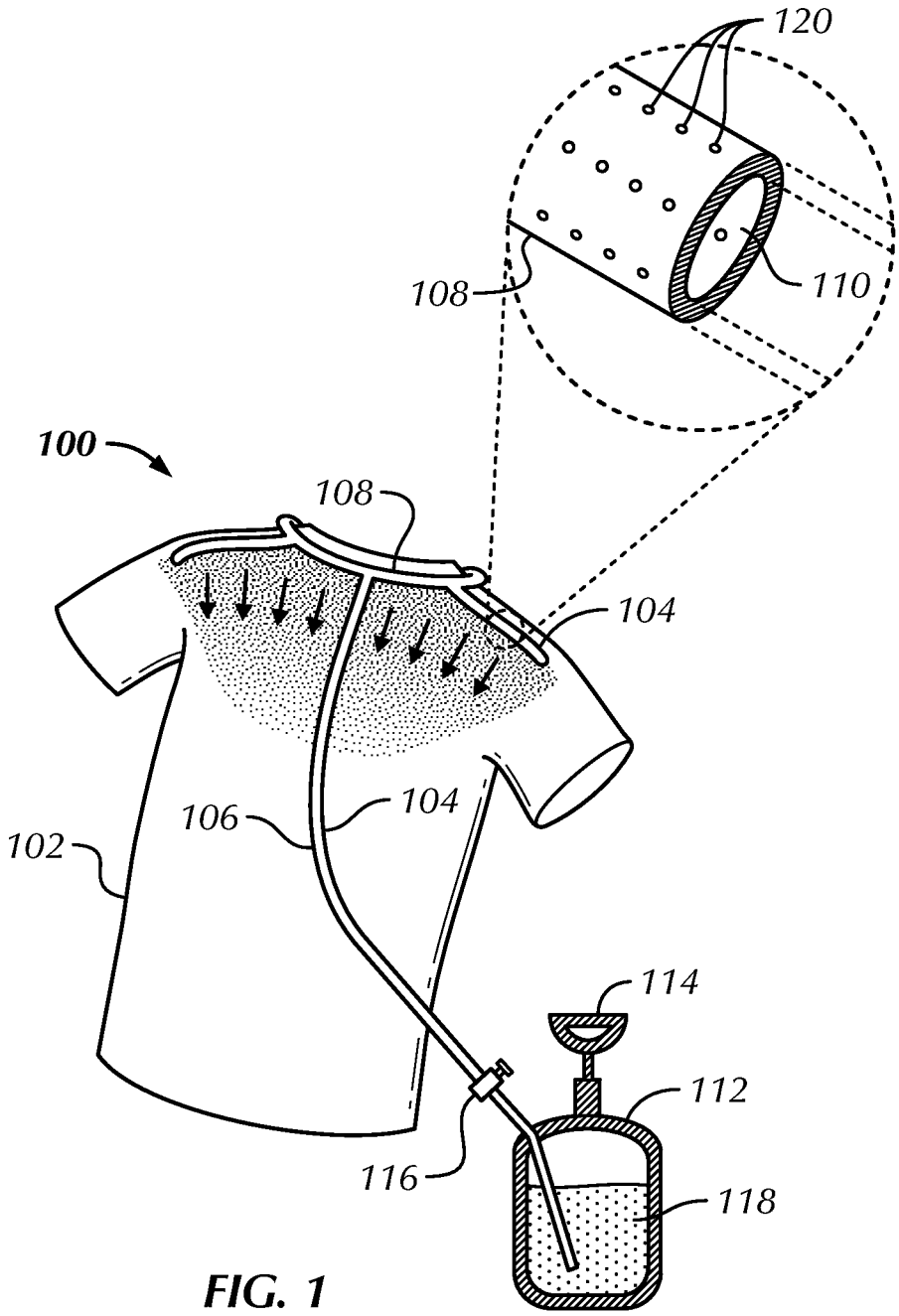
FIG. 1 is a drawing illustrating a rear view of an exemplary clothing system for reducing body temperature of a wearer of the clothing system according to embodiments of the present invention.

Exemplary embodiments of clothing systems for reducing body temperature of a wearer of the clothing systems through evaporative cooling are described herein with reference to the accompanying drawings, beginning with FIG. 1. FIG. 1 sets forth a drawing illustrating a rear view of an exemplary clothing system (100) for reducing body temperature of a wearer of the clothing system (100) according to embodiments of the present invention. Body temperature is a measure of the thermal energy of a person's body and is often expressed in units of degrees using a Fahrenheit or Celsius temperature scale. Readers will note that the wearer of the exemplary clothing system (100) is omitted from FIG. 1 and the remaining FIGS. 2-6 for clarity.

The exemplary clothing system (100) of FIG. 1 includes a clothing article (102). The clothing article (102) of FIG. 1 is implemented as a garment for covering an upper torso of the garment's wearer such as, for example, a shirt or a jacket. The clothing article (102) of FIG. 1 is configured using a wicking fabric. A fabric is a flexible material comprised of a network of natural or artificial fibers and is often referred to as a 'textile.' A wicking fabric is a fabric that draws moisture into itself by means of capillary action. Capillary action occurs when the adhesive intermolecular forces between the liquid and a material are stronger than the cohesive intermolecular forces inside the liquid, thereby causing the liquid to disperse along the surface area of the material. Fibers useful in creating such wicking fabrics may be made from synthetic materials such as, for example, polyester and polyester-based microfibers and natural materials such as, for example, silk. These exemplary material are useful because fibers made from these materials do not absorb moisture but transfer it well through capillary action.

The clothing article (102) of FIG. 1 may be made in part or wholly from wicking fabric. In FIG. 1, the wicking fabric forms the interior surface of the clothing article (102) and draws moisture away from the wearer's body. The exterior surface of the clothing article (102) may be made from wicking fabric or some other material that allows the moisture in the clothing article to evaporate into the surrounding environment.

Optionally, the wicking fabric used to form the clothing article (102) may include ultraviolet light absorbers. These ultraviolet light absorbers may be applied to the wicking fabric to block certain harmful radiation in sunlight from reaching the wearer's skin. Examples of ultraviolet light absorbers that may be useful in embodiments of the present invention may include compounds having benzotriazoles, more particularly chlorobenzotriazoles, or any other ultraviolet light absorber as will occur to those of skill in the art.

In FIG. 1, the exemplary clothing system (100) also includes a hollow transport (104) that defines a cavity (110) for transporting a liquid (118) from a liquid reservoir (112) to an upper region of the clothing article (102). The upper region refers to the highest regions of the clothing article when the clothing article is positioned upright or oriented in a typical position utilized by a wearer. In FIG. 1, for example, the upper region of the clothing article (102) includes the regions along the neck and the two shoulders because those regions are the highest regions of the clothing article (102) when the article (102) is positioned upright, a typical orientation for the article (102) when worn.

In the example of FIG. 1, the hollow transport (104) is tubular. The tubular structure in FIG. 1 provides the cavity (110) with a circular cross-section. Readers will note, however, that the cavity (110) may be formed to have other cross-sectional shapes such as, for example, a rectangle, a trapezoid, an ellipse, and so on.

In FIG. 1, the liquid reservoir (112) is positioned below the upper region of the clothing article (102). Accordingly, the liquid (118) is stored in the liquid reservoir (112) under pressure to provide a force capable of moving the liquid through the cavity (110) of the hollow transport (104) to the clothing article's upper region. The pressure in the liquid reservoir (112) is generated using an manual air pump (114) configured as a handle for the liquid reservoir (112). A user may operate the air pump (114) by sliding the handle portion of the air pump (114) back and forth. Readers will note that the liquid reservoir (112) depicted in FIG. 1 is for example only and not for limitation. A liquid reservoir useful with the exemplary clothing system (100) of FIG. 1 may take on many forms. For example, the liquid reservoir may be configured as a backpack, fanny pack, or any other article worn by the wearer of the exemplary clothing system (100). Rather than carry the liquid reservoir around with the wearer of the clothing system, in some embodiments, the liquid reservoir may already be mounted in locations that wearers of the clothing system would typically require additional cooling. For example, a liquid reservoir may be mounted to a bicycle or a motorcycle so that a wearer of the clothing system (100) could connect the hollow transport (104) to the reservoir (112) when riding either vehicle using, for example, a quick-connect connector.

Also readers will note that the use of a manual pump to pressurize the liquid is only for example and explanation, not for limitation. In some other embodiments, the liquid reservoir may utilize an electric-powered air pump. In still other embodiments the pressurization may result from a replaceable, pressurized air cartridge installed in the liquid reservoir such as, for example, $CO_2$ cartridges. In still other embodiments, the liquid (118) may not be stored in the liquid reservoir (112) under pressure at all. In such embodiments, an pump may be used to draw the water out of the liquid reservoir (112) and force the liquid (118) into the hollow transport (104).

The liquid (118) of FIG. 1 may be implemented as any liquid that readily evaporates at the typical temperatures and pressures in which the clothing article is worn. Because of the liquid's proximity to the body and the liquid vapor's potential ability to enter the wearer's lungs, care should be taken to select a liquid that is not toxic to the wearer of the clothing article (102). For example, the liquid (118) may be implemented using water or an alcohol-water mixture.

The hollow transport (104) of FIG. 1 has an intake section (106) and a dispensing section (108) that converge at the neck region of the clothing article (102). The intake section (106)

and the dispensing section (108) may be formed from a single hollow structure, thereby permanently attaching the intake section (106) to the dispensing section (108). However, in other embodiments, the intake section (106) and the dispensing section (108) may each be formed as a separate structure and removably attached together using a connector such as, for example, a quick-connect connector.

The intake section (106) of FIG. 1 receives the liquid (118) into the cavity (110) formed by the hollow transport (104) and transports the liquid from the liquid reservoir (112) to the dispensing section (108) attached to the upper region of the clothing article (102). The intake section (106) is typically made of a flexible material to reduce restrictions on the wearer's movements. However, a portion or all of the intake section (106) may be designed using rigid materials for some embodiments in which the wearer's position in relation to the liquid reservoir does not change appreciably. Materials useful in forming the intake section (106) may include polyethylene, vinyl, synthetic rubber, natural rubber, or any other material capable of forming a hollow structure that is not permeable to the liquid.

In the example of FIG. 1, the clothing system (100) includes a valve (116) attached to the intake section (106). The value (116) of FIG. 1 regulates the rate at which the liquid is received by the hollow transport (104). Opening the value (116) allows more liquid (118) to flow through the hollow transport (104), thereby enhancing the cooling effect for the wearer. Closing the value (116) restricts the quantity of liquid (118) flowing through the hollow transport (104), thereby reducing the cooling effect for the wearer.

In the example of FIG. 1, the dispensing section (108) is configured along the neck region and the two shoulder regions of the clothing article (102). The dispensing section (108) of FIG. 1 may be removably attached to the upper region of the clothing article (102). Removable attachment may be achieved using fasteners at various points along the dispensing section (108). The fasteners may be implemented as strips of fabric or other material that attached to the clothing article using buttons, Velcro®, or the like. Removable attachment may also be achieved through use of a sheath attached to the upper region of the clothing article (102). A wearer may attach the dispensing section (108) to the clothing article's upper region by inserting the one or more pieces of the dispensing section (108) into each piece's respective sheath and then connecting the pieces together using connectors such as, for example, quick-connect connectors. The wearer may then remove the dispensing section (108) from the clothing article (102) by disconnecting any pieces of the dispensing section (108) and sliding the pieces out of their respective sheaths.

Although removably attaching the dispensing section (108) to the clothing article (102) facilitates certain activities such as, for example, washing the clothing article (102), readers will note that that the dispensing section (108) may also be permanently attached to the clothing article. Permanent attachment may be achieved by sewing the dispensing section (108) into the upper region of the clothing article (102), through use of an adhesive, or in other ways as will occur to those of skill in the art.

In the example of FIG. 1, the dispensing section (108) transfers the liquid (118) from the cavity (110) of the hollow transport (104) to the upper region of the clothing article (102). The dispensing section (108) of FIG. 1 transfers the liquid (118) through a plurality of orifices (120) included in the dispensing section (108). These orifices (120) allow the liquid (118) to pass through an impermeable material used to form the wall of the dispensing section (108). The impermeable material may be implemented using same materials used to form the intake section (106) such as, for example, polyethylene, vinyl, synthetic rubber, natural rubber, or any other impermeable material capable of forming a hollow structure.

In some other embodiments, the dispensing section (108) may be implemented using a permeable or semi-permeable material. In such embodiments, the dispensing section (108) may transfer the liquid (118) to the upper region of the clothing article (102) by passing the liquid through the pores of the permeable or semi-permeable material that form the dispensing section (108). Pressure in the liquid reservoir (112) forces the liquid (118) through pores in permeable or semi-permeable material, thereby delivering the liquid (118) to the upper region of the clothing article (102). Permeable or semi-permeable materials that used to form the dispensing section (108) may include, for example, ceramic, porous plastics, compressed cellulose, or any other porous material capable of forming a hollow structure.

In the example of FIG. 1, the upper region of the clothing article (102) receives the liquid (118) from the dispensing section (108) and transfers the liquid (118) to a lower region of the clothing article. The clothing article's upper regions transfers the liquid (118) to the lower region through capillary action provided by the wicking fabric and gravity. Gravitational forces typically allow the liquid (118) to extend to a lower region of the clothing article (102) than capillary action alone could provide. FIG. 1 illustrates the transfer of the liquid (118) from the clothing article's upper region to the lower region using arrows.

As the liquid (118) of FIG. 1 moves from the clothing article's upper region to the lower region, these regions become saturated with the liquid (118). For illustration, FIG. 1 depicts the saturated areas in the upper region and the lower region of the clothing article (102) using grey shading. At these saturated areas in the example of FIG. 1, the lower region along the back of the clothing article (102) exposes the liquid (118) to the environment surrounding the clothing article (102) for evaporation. The evaporation process removes thermal energy from the clothing article, and lowers the overall temperature of the clothing article (102). In turn, the lower temperature of the clothing article (102) cools the wearer of the clothing system (100).

Figure 2:
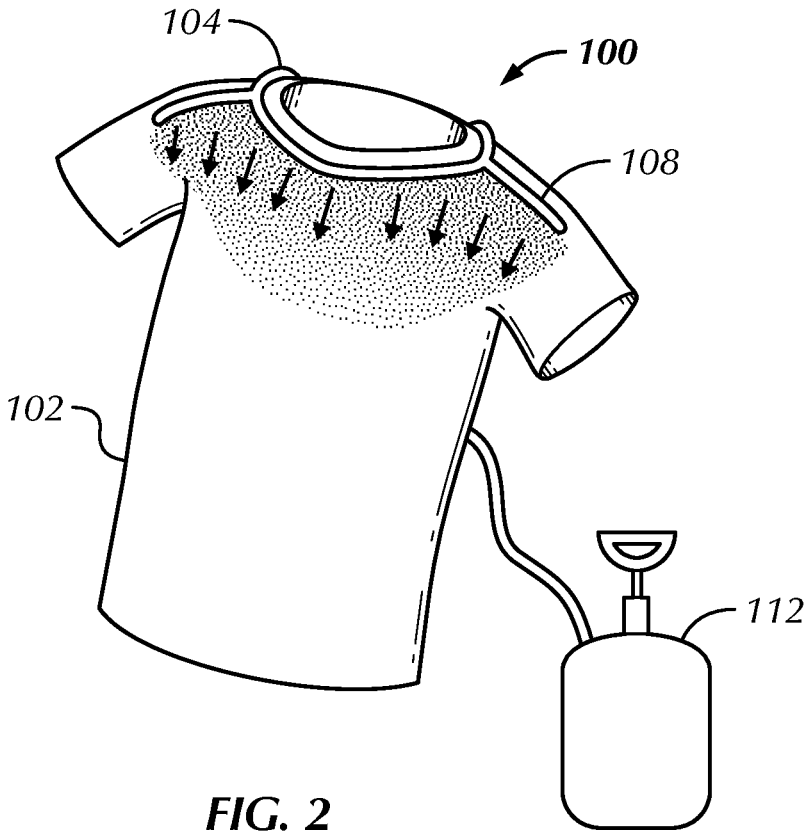
FIG. 2 is a drawing illustrating a front view of the exemplary clothing system illustrated in FIG. 1 for reducing body temperature of a wearer of the clothing system according to embodiments of the present invention.

For further explanation, FIG. 2 sets forth a drawing illustrating a front view of the exemplary clothing system (100) illustrated in FIG. 1 for reducing body temperature of a wearer of the clothing system (100) according to embodiments of the present invention. As described in FIG. 1, the dispensing section (108) of the hollow transport (104) transfers the liquid from the liquid reservoir (112) to the upper region of the clothing article (102). As previously mentioned, the clothing article's upper region includes the regions adjacent to the wearer's neck and two shoulders. The upper region of the clothing article (102) transfers the liquid to the lower region through gravity and capillary action provided by the wicking fabric. FIG. 2 illustrates this transfer of the liquid using arrows.

In the example of FIG. 2, the lower region along the front of the clothing article (102) becomes saturated with the liquid as the liquid moves from the clothing article's upper region to the lower region. FIG. 2 illustrates the saturated areas of the clothing article (102) using grey shading. Through these saturated areas in the example of FIG. 2, the lower region along the front of the clothing article (102) exposes the liquid (118) to the environment surrounding the clothing article (102) for evaporation. The evaporation process removes thermal energy from the clothing article, and lowers the overall temperature of the clothing article (102). In turn, the lower temperature of the clothing article (102) cools the wearer of the clothing system (100).

Although FIGS. 1 and 2 illustrate front and rear portions of the dispensing section (108), readers will note that there is no requirement that the dispensing section (108) have both a front portion and a rear portion. The dispensing section (108) may be attached only at either the upper front region of the clothing article (102) or the upper rear region of the clothing article (102). Also in embodiments in which the clothing article is implemented as a garment covering the upper torso, readers will note that there is no requirement that the dispensing section (108) be configured along both shoulder regions. In fact, in some embodiments, the garment may be designed with only one should region to provide the wearer's arm on the opposite side of the garment additional freedom of movement.

As mentioned above, the cavity of a hollow transport may be formed to have a variety of cross-sectional shapes and may be attached to the upper region of a clothing article using a sheath. To further illustrate these features, FIGS. 3A and 3B are drawings illustrating cross-sectional views of hollow transports useful in exemplary clothing systems for reducing body temperature of a wearer of the clothing systems according to embodiments of the present invention.

Figure 3A:
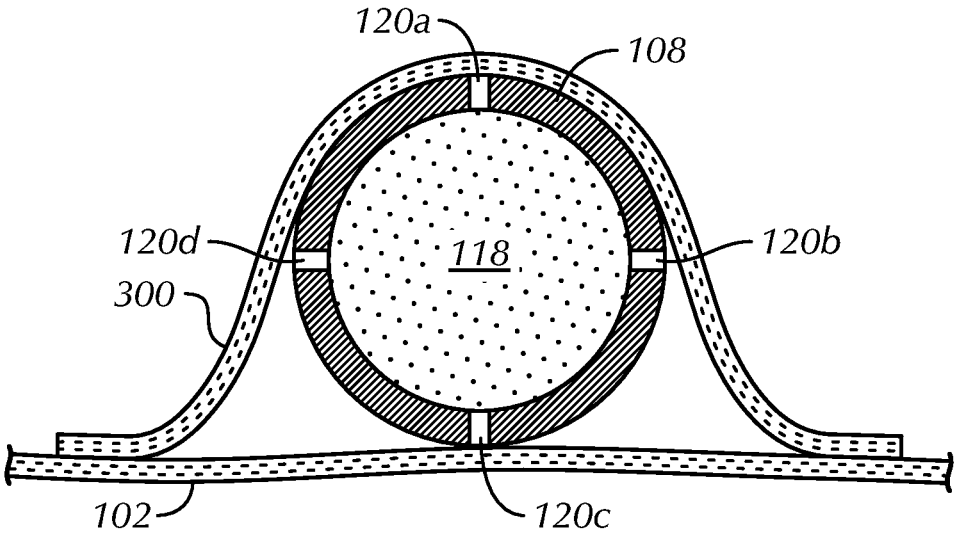
FIGS. 3A and 3B are drawings illustrating cross-sectional views of hollow transports useful in exemplary clothing systems for reducing body temperature of a wearer of the clothing systems according to embodiments of the present invention.

In the example of FIG. 3A, the dispensing section (108) of the hollow transport defines a cavity with a circular cross-section. The dispensing section (108) of the hollow transport in FIG. 3A is attached to the upper region of the clothing article (102) using a sheath (300). The sheath (300) of FIG. 3A attaches to the clothing article (102) to form an enclosed opening into which the dispensing section (108) may be inserted. The dispensing section (108) includes a plurality of orifices (120) that allow the hollow transport to transfer the liquid (118) from the cavity to the upper region of the clothing article (102). In the example of FIG. 3A, the sheath (300) may be configured from a wicking fabric similar to the fabric used in the clothing article (102), although use of a wicking fabric is not a requirement of embodiments of the present invention. The sheath (300) may be attached to the clothing article (102) using, for example, thread, adhesive, or any other technique as will occur to those of skill in the art.

Figure 3B:
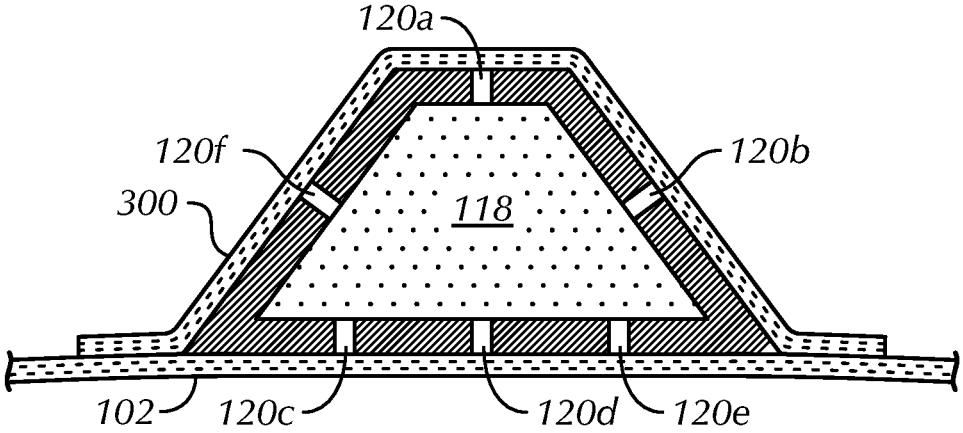

In the example of FIG. 3B, the dispensing section (108) of the hollow transport defines a cavity with a trapezoidal cross-section. Similar to FIG. 3A, the dispensing section (108) of the hollow transport in FIG. 3B is attached to the upper region of the clothing article (102) using a sheath (300). The sheath (300) in FIG. 3B attaches to the clothing article (102) to form an enclosed opening into which the dispensing section (108) may be inserted. The dispensing section (108) includes a plurality of orifices (120) that allow the hollow transport to transfer the liquid (118) from the cavity to the upper region of the clothing article (102). Readers will note that some of the orifices (120) in FIGS. 3A and 3B are not adjacent to the clothing article (102). The sheaths (300) in FIGS. 3A and 3B operate to guide the liquid (118) from those non-adjacent orifices (120) to the clothing article (120).

As mentioned above, a dispensing section (108) of a hollow transport (104) may be attached to the clothing article (102) using fasteners at various points along dispensing section (108). The outer surface of the dispensing section (108) not covered by one of the fasteners is therefore exposed to the surrounding environment. Unlike embodiments that utilize a sheath (300), the only structure to guide the liquid (118) from these exposed areas on the dispensing section's outer surface is dispensing section (108) itself as the liquid (118) runs down the outer wall of the dispensing section (108) to the clothing article (102). To aid in guiding the flow of liquid (118) that forms on this exposed outer surface to the clothing article's upper region, the dispensing section (108) may be wrapped in a fabric to distribute the liquid around the outer surface of the dispensing section (108). For further explanation, FIG. 4 is a drawing illustrating a cross-sectional view of a dispensing section (108) of a hollow transport useful in exemplary clothing systems for reducing body temperature of a wearer of the clothing systems according to embodiments of the present invention.

Figure 4:
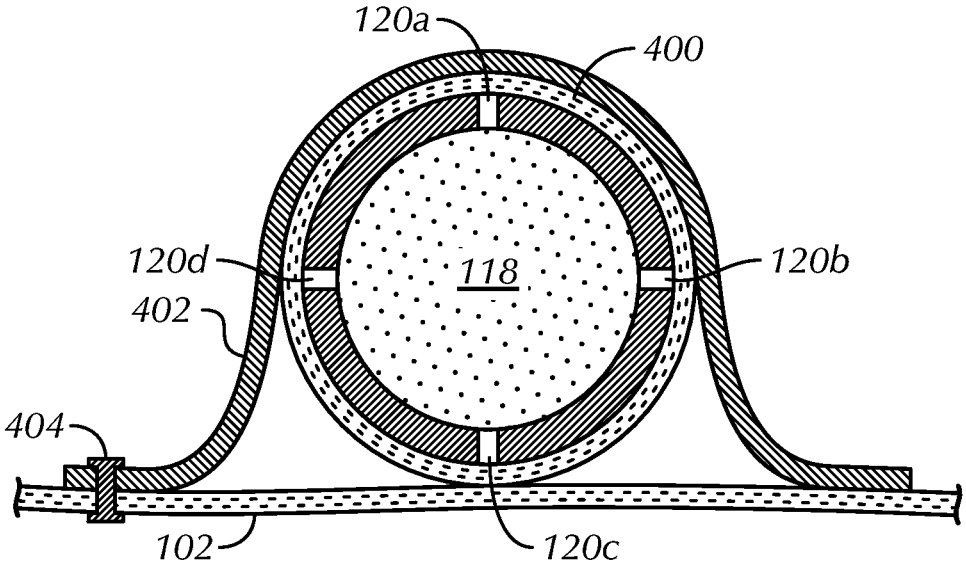
FIG. 4 is a drawing illustrating a cross-sectional view of a dispensing section of a hollow transport useful in exemplary clothing systems for reducing body temperature of a wearer of the clothing systems according to embodiments of the present invention.

The dispensing section (108) of the hollow transport in FIG. 4 is attached to the upper region of the clothing article (102) using fasteners at various points along dispensing section (108). FIG. 4 illustrates a fastener constructed using a strip of flexible material (402) attached to the clothing article (102) at one end and fastened to the clothing article (102) at the other end using a button (404).

In the example of FIG. 4, the dispensing section (108) is wrapped in a fabric (400) to distribute the liquid (118) around the outer surface of the dispensing section (108) as the liquid is expelled from the cavity of the hollow transport through the orifices (120). The fabric (400) may be the same type of fabric used to form the clothing article (102)—that is, a wicking fabric. Readers will note, however, that use of a wicking fabric to wrap the dispensing section (108) is for explanation only and not for limitation. In the example of FIG. 4, the fabric (400) transports the liquid (118) expelled from orifices (120*a*, 120*b*, 120*d*) to the region where the fabric (400) touches to the upper region of the clothing article (102). As mentioned above, the upper region of the clothing article (102) then transfers the liquid (118) to the clothing article's lower region, which in turn exposes the liquid (118) to the surrounding environment for evaporation.

Figure 5:
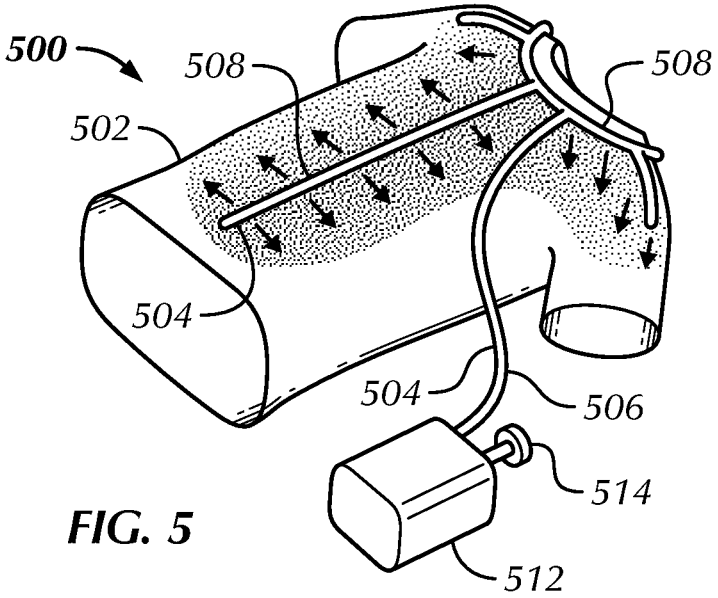
FIG. 5 is a drawing illustrating another exemplary clothing system for reducing body temperature of a wearer of the clothing system according to embodiments of the present invention.

FIGS. 1 and 2 depict a garment for covering the torso in which the upper region is implemented as the regions along the wearer's neck and shoulders because the typical position utilized by a wearer of that clothing article is upright. However, in some sports such as, for example, cycling, the position typically utilized by a wearer of a clothing article is with the shoulders placed forward and the back facing upward. Consider FIG. 5 for further explanation of how exemplary embodiments of the present invention may be utilized with clothing articles typically positioned in such a manner. FIG. 5 sets forth a drawing illustrating another exemplary clothing system (500) for reducing body temperature of a wearer of the clothing system (500) according to embodiments of the present invention.

Similar to FIGS. 1 and 2, the exemplary clothing system (500) of FIG. 5 includes a clothing article (502) configured using a wicking fabric. The exemplary clothing system (500) of FIG. 5 also includes a hollow transport (504) defining a cavity for transporting a liquid from a liquid reservoir (512) to an upper region of the clothing article (502). The hollow transport (504) of FIG. 5 has an intake section (506) and a dispensing section (508). The intake section (506) is attached to the liquid reservoir (512) for receiving the liquid. The liquid is pressurized in the liquid reservoir (512) using the air pump (514) attached to the reservoir (512).

In the example of FIG. 5, the clothing article (502) is implemented as a garment that covers the upper torso of the garment's wearer. The garment has, among others, a neck region, two shoulder regions, and a spinal region. The spinal region extends along a center rear portion of the garment. The dispensing section (508) of FIG. 5 is attached to the upper region of the clothing article (502) along these neck, shoulder, and spinal regions.

The dispensing section (508) of FIG. 5 transfers the liquid from the hollow transport (504) to the clothing article's upper region. The upper region of the clothing article (502) transfers the liquid to the lower region of the clothing article (502). FIG. 5 illustrates the movement of the liquid from the upper region of the clothing article to the lower region of the clothing article using arrows. As the liquid moves to the lower region, the upper and lower regions of the garment become saturated. FIG. 5 illustrates the saturated areas of the clothing article (502) using grey shading. In these saturated regions, the clothing article's lower region exposes the liquid to the environment surrounding the clothing article (502) for evaporation. In FIG. 5, the portion of the dispensing section along the spinal region of the clothing article (502) advantageously saturates a large area along the back of the garment. As air flows over this large area of saturation, considerable cooling is provided to the wearer of the clothing system (500) as the liquid evaporates.

Figure 6:
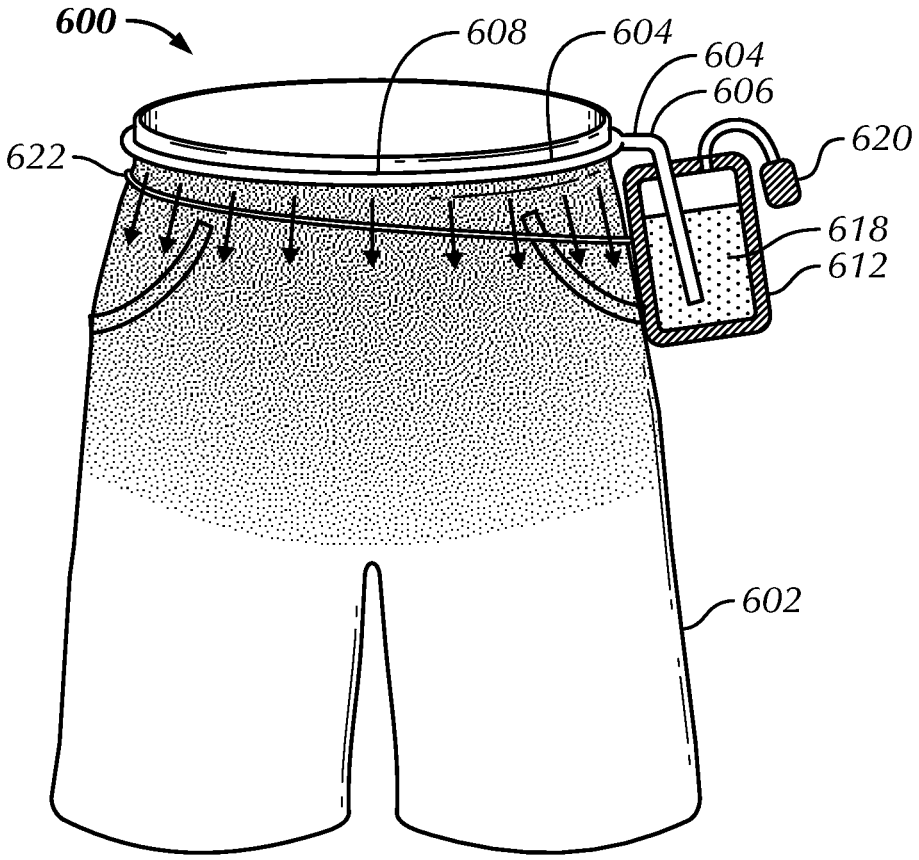
FIG. 6 is a drawing illustrating another exemplary clothing system for reducing body temperature of a wearer of the clothing system according to embodiments of the present invention.

FIGS. 1, 2, and 5 illustrate exemplary clothing systems according to embodiments of the present invention in which the clothing articles are implemented as garments that cover a wearer's torso. Readers will note, however, that such implementations are for illustration only and not for limitation. For further explanation, consider FIG. 6 that sets forth a drawing illustrating another exemplary clothing system (600) for reducing body temperature of a wearer of the clothing system (600) according to embodiments of the present invention. In the example of FIG. 6, the clothing system (600) includes a clothing article (602) implemented as a garment for covering the lower half of the body of the wearer, specifically a pair of shorts. The clothing article (602) of FIG. 6 is configured using a wicking fabric as described above.

The exemplary clothing system (600) of FIG. 6 includes a hollow transport (604) that defines a cavity for transporting a liquid (618) from a liquid reservoir (612) to an upper region of the clothing article (602). The hollow transport (604) of FIG. 6 has an intake section (606) and a dispensing section (608). The intake section (606) is attached to the liquid reservoir (612) and receives the liquid (618) for delivery to the dispensing section (608).

In the example of FIG. 6, the liquid reservoir (612) is configured as a fanny pack attached to the wearer using a strap (622). The liquid reservoir (612) of FIG. 6 includes a bulb pump (620) that the wearer may operate to pressurize the liquid (618) in the liquid reservoir (612). This pressure then forces the liquid (618) into the intake section (606), and then throughout the hollow transport (604). Readers will note that the bulb pump (620) illustrated in FIG. 6 is for explanation only and not for limitation. Other kinds of pumps as will occur to those of skill in the art may also be used to force the liquid (618) throughout the hollow transport (104).

The dispensing section (608) of FIG. 6 is attached to the upper region of the clothing article (602). The upper region of the clothing article (602) in FIG. 6 has a waist region that is implemented around the waist of the shorts because the shorts illustrated in FIG. 6 are typically positioned upright when worn. The dispensing section (608) of FIG. 6 includes a plurality of orifices through which the liquid (618) is transferred to the upper region of the clothing article (602). The pressure created by operation of the bulb pump (606) provides the force needed to move the liquid (618) through the orifices in the dispensing section (608). As previously mentioned, transferring the liquid (618) from the dispensing section (608) to the clothing article's upper region through a plurality of orifices is for explanation only and not for limitation. In some other embodiments, the dispensing section (608) may be composed of a permeable or semi-permeable material having pores through which the liquid (618) may seep from the dispensing section's cavity to the upper region of the clothing article (602).

In the example of FIG. 6, the upper region of the clothing article (602) receives the liquid (618) from the dispensing section (608) and transfers the liquid (618) to a lower region of the clothing article (602). Capillary action and gravity are the mechanisms by which the liquid (618) is received and distributed throughout the fabric of the clothing article (602). As the liquid (618) moves through the clothing article (602), a portion of the clothing article (602) become saturated. FIG. 6 illustrates the saturated portion of the clothing article (602) using grey shading.

As described above, the lower region of the clothing article (602) exposes the liquid to the environment surrounding the clothing article (602) for evaporation. As the liquid (618) evaporates, the temperature of the clothing article (602) drops at the points of evaporation, reflecting the lower level of thermal energy at these evaporation points than the thermal energy levels before the evaporation. At this lower temperature, the clothing article absorbs the thermal energy released by the wearer's body, thereby reducing the wearer's body temperature.

While certain exemplary embodiments have been described in details and shown in the accompanying drawings, it is to be understood that such embodiments are merely illustrative of and not devised without departing from the basic scope thereof, which is determined by the claims that follow.

I claim:

1. An evaporative cooling clothing system for reducing body temperature of a wearer of the clothing system, the clothing system comprising:

a clothing article configured using a wicking fabric, the clothing article is a garment for covering an upper torso of the wearer; and a hollow transport defining a cavity for transporting a liquid from a liquid reservoir to an upper region of the clothing article, the upper region of the garment having a neck region and a shoulder region, the hollow transport having an intake section and a dispensing section, the intake section attached to the liquid reservoir for receiving the liquid, the dispensing section attached to the upper region of the clothing article, the dispensing section is configured along the neck region and the shoulder region, the upper region of the clothing article receiving the liquid from the dispensing section and transferring the liquid to an other region of the clothing article, and the other region of the clothing article exposing the liquid to an environment surrounding the clothing article for evaporation.

2. The system of claim 1 wherein the dispensing section includes a plurality of orifices through which the dispensing section transfers the liquid from the cavity to the upper region of the clothing article.

3. The system of claim 1 further comprising a valve attached to the intake section to regulate the rate at which the liquid is received by the hollow transport.

4. The system of claim 1 wherein:

the upper region of the garment having a neck region, a shoulder region, and a spinal region, the spinal region extending along a center rear portion of the garment; and the dispensing section is configured along the neck region, the shoulder region, and the spinal region.

5. The system of claim 1 wherein the dispensing section is removably attached to the upper region of the clothing article.

6. The system of claim 1 wherein the dispensing section is attached to the upper region of the clothing article by insertion into a sheath attached to the upper region of the clothing article.

7. The system of claim 1 wherein the dispensing section is wrapped in a fabric to distribute the liquid around an outer surface of the dispensing section.

8. The system of claim 1 wherein the hollow transport is tubular.

9. The system of claim 1 wherein the wicking fabric includes an ultraviolet light absorber.

10. A method of evaporatively cooling clothing to reduce body temperature of a wearer of the clothing, the method comprising:

transporting, by a hollow transport through a cavity defined by the hollow transport, a liquid from a liquid reservoir to an upper region of a clothing article configured using a wicking fabric;

transferring the liquid from the hollow transport to the upper region of the clothing article;

transferring, by the upper region of the clothing article, the liquid to a lower region of the clothing article; and exposing, by the lower region of the clothing article, the liquid to an environment surrounding the clothing article for evaporation.

11. The method of claim 10 wherein transferring the liquid from the hollow transport to the upper region of the clothing article further comprises transferring the liquid from the cavity to the upper region of the clothing article through a plurality of orifices in the hollow transport.

12. The method of claim 10 wherein transporting, by a hollow transport, a liquid from a liquid reservoir to an upper region of a clothing article configured using a wicking fabric further comprises regulating, by a valve attached to the hollow transport, the rate at which the liquid is received.

13. The method of claim 10 wherein:

the clothing article is a garment for covering an upper torso of the wearer, the upper region of the garment having a neck region and a shoulder region; and transferring, by the hollow transport, the liquid to the upper region of the clothing article further comprises transferring the liquid to the neck region and the shoulder region of the garment.

14. The method of claim 10 wherein:

the clothing article is a garment for covering an upper torso of the wearer, the upper region of the garment having a neck region, a shoulder region, and a spinal region, the spinal region extending along a center rear portion of the garment; and transferring, by the hollow transport, the liquid to the upper region of the clothing article further comprises transferring the liquid to the neck region, the shoulder region, and the spinal region of the garment.

15. An evaporative cooling clothing system for reducing body temperature of a wearer of the clothing system, the clothing system comprising:

a clothing article configured using a wicking fabric, wherein the clothing article is a garment for covering the lower half of the body of the wearer, the upper region of the garment having a waist region; and a hollow transport defining a cavity for transporting a liquid from a liquid reservoir to an upper region of the clothing article, the hollow transport having an intake section and a dispensing section, the intake section attached to the liquid reservoir for receiving the liquid, the dispensing section attached to the upper region of the clothing article, the dispensing section is configured along the waist region, the upper region of the clothing article receiving the liquid from the dispensing section and transferring the liquid to an other region of the clothing article, and the other region of the clothing article exposing the liquid to an environment surrounding the clothing article for evaporation.

16. The system of claim 15 wherein the dispensing section includes a plurality of orifices through which the dispensing section transfers the liquid from the cavity to the upper region of the clothing article.

17. The system of claim 15 wherein the dispensing section is removably attached to the upper region of the clothing article.

18. The system of claim 15 wherein the dispensing section is attached to the upper region of the clothing article by insertion into a sheath attached to the upper region of the clothing article.

19. The system of claim 15 wherein the dispensing section is wrapped in a fabric to distribute the liquid around an outer surface of the dispensing section.

20. The system of claim 15 wherein the hollow transport is tubular.

* * * * *